US006058747A

United States Patent [19]

Doyle et al.

[11] Patent Number: 6,058,747

[45] Date of Patent: May 9, 2000

[54] LATCHES FOR GATES

[75] Inventors: David Thomas Doyle, North Manly; Anthony John Clark, Cremorne, both of Australia; Iulian Danut Turlea, Bucharest, Romania

[73] Assignee: D & D Group PTY Limited, Brookvale, Australia

[21] Appl. No.: 09/133,610

[22] Filed: Aug. 13, 1998

[30] Foreign Application Priority Data

Aug. 14, 1997 [AU] Australia ..... 34178/97
Mar. 12, 1998 [AU] Australia ..... PP2317

[51] Int. Cl.[7] ..... E05B 57/00; E05C 19/12

[52] U.S. Cl. ..... 70/137; 70/139; 292/135; 292/210; 292/DIG. 25

[58] Field of Search ..... 292/133, 134, 292/135, 127, 225, 227, 235, 230, 238, 207, DIG. 25, 136, 108, 210; 70/154, 155, 102, 77, 137, 139

[56] References Cited

U.S. PATENT DOCUMENTS

| | | | |
|---|---|---|---|
| 204,267 | 5/1878 | Unger | 292/135 |
| 2,313,712 | 3/1943 | Jacobi | 292/127 |
| 2,953,916 | 9/1960 | Thomas | 70/77 |
| 3,115,026 | 12/1963 | Moore | 292/238 |
| 3,593,547 | 7/1971 | Taylor | 292/108 |
| 3,785,186 | 1/1974 | James et al. | 292/216 |
| 3,838,877 | 10/1974 | Hanson | 292/134 |
| 4,014,192 | 3/1977 | Dillon et al. | 70/77 |
| 4,691,541 | 9/1987 | McQuade et al. | 292/238 |
| 4,919,463 | 4/1990 | McQuade, Sr. | 70/137 |
| 4,938,508 | 7/1990 | Thomas | 292/207 |
| 5,024,473 | 6/1991 | McQuade | 70/137 |
| 5,063,764 | 11/1991 | Amis et al. | 292/207 |
| 5,358,292 | 10/1994 | Van Wiebe et al. | 292/235 |

FOREIGN PATENT DOCUMENTS

| | | | |
|---|---|---|---|
| 25197 | 11/1936 | Australia | 292/237 |
| 2405347 | 6/1979 | France | 70/139 |

*Primary Examiner*—Darnell M. Boucher
*Attorney, Agent, or Firm*—Davis and Bujold

[57] ABSTRACT

The present invention relates to latches, and in particular gravity latches. The latch comprises a housing which integrally mounts together with the latch a lock mechanism The latch can therefore be locked. The lock mechanism is such that the latch can also be locked in the open position.

A further mechanism is also provided which enables operation of the latch from the opposite side of the fence, gate or door to where the latch is mounted.

9 Claims, 11 Drawing Sheets

LATCHES FOR GATES

The present invention relates to latches, and in particular to gravity latches.

Gravity latches are well known. They provide a simple mechanical closure mechanism generally used with gates or outside doors and fences and the like.

Such latches usually comprise a closure mechanism which includes a pivotally mounted tongue closure plate having a tongue extending therefrom and being moveable between a first and a second position. The tongue is arranged to close over a striker arm, in its second position, to retain the striker arm, and effect closure of the arrangement. The tongue closure plate is pivotably mounted for pivoting towards the first position in order to enable the striker arm to be removed to open the latch arrangement. The gravity latch is biased by gravity towards the second position, so that the latch arrangement will remain closed until the tongue plate is moved towards the first position by a user. A forward facing edge of the tongue plate is shaped so that when it is engaged by the striker arm on closure of the door or gate to which the striker arm is usually mounted, the forward facing edge rides up the striker arm and causes the tongue closure plate to pivot to the first position, until the striker arm passes under an extending portion of the tongue and engages with a socket portion of the tongue closure plate. The gravity latch then returns by gravity to its second position. The gate can, therefore, be closed without it being necessary for the user to physically actuate the gravity latch, but cannot be opened without the user moving the tongue closure plate physically from the second to the first position.

It is known in some gravity latches to provide a locking arrangement, usually comprising a hole provided in the tongue plate for receiving a padlock arm. With the padlock in place, movement of the tongue closure plate from the second to the first position is prevented. A problem with this arrangement is that a padlock can often be misplaced, as to unlock the latch the padlock must be separated from the latch.

Another problem with known gravity latches is that it is only usually possible to effect opening of the latch from one side of the fence or gate. A person on the other side of the fence or gate must usually lean over the fence or gate or reach through a hole in the fence or gate to reach the tongue closure plate to move it from its second to its first position. This can often be awkward and difficult.

According to a first aspect of the present invention, there is provided a gravity latch adapted to be mounted on a gate post or similar structure and engage with a striker arm mounted on a gate, the gravity latch comprising:

(a) a housing adapted to be mounted on a gate post, (b) a pivoted latch element pivotally mounted in the housing for rotation about a horizontal axis between a first position and a second position and having an interior recess for retaining a portion of the striker arm when the latch element is in the second position, (c) the housing having a lateral aperture through which the striker arm is accepted to pass towards the horizontal axis to engage the latch element, (d) the latch element having:

(i) gravity biasing towards the second position;

(ii) a striker surface adapted to be engaged by the striker arm upon closing of the gate to rotate the latch element towards the first position thereby exposing an entry into the recess;

(iii) a profile for the interior recess to retain the striker arm therein against pressure away from the horizontal axis when the latch element has dropped to the second position, (e) a retraction element extending from the housing and adapted to move under hand pressure and displace the latch element from the second position to the first position to release the striker arm; and wherein (f) the housing has means for guiding the latch element during rotation between the first and second positions, the guiding means being remote from the horizontal axis, and (g) the gravity latch has a lock structure accessible by a key through the front of the latch and on the opposite side thereof to the gate post, the lock structure being arranged to lock the latch element at least in the second position by engagement with a portion thereof.

For convenience the invention has been described with reference to an intended application namely to be mounted on a gate post but equally apparatus according to the invention can be applied for other analogous purposes. Furthermore, the installation could be reversed with the gravity latch mounted on a gate and the striker arm mounted on a gate post or other fixed structure; broadly the invention is one in which the gravity latch is capable of being mounted on a gate post or similar fixed structure.

Of particular significance to the latches embodying the invention is the adoption of a combination of features with the lock structure accessible from the front of the latch. This concept permits the design of a product which can be installed in restricted access situations such as where a wall extends adjacent a gate post. Furthermore, a relatively thin, neat and elegant housing can be provided with secure mounting of the lock and a well-engineered guided gravity latch. Security can be provided in an economic manner.

Preferably the housing is an elongated moulded housing of synthetic material which accommodates the lock structure in a base portion, the lock structure having a lock element adapted to engage a downwardly depending tongue portion of the latch element.

Preferred embodiments of the invention have a latch element in the form of a thin plate-like element which has an upper portion being a clearance fit between cheeks of the housing between which a slot is defined.

Preferably the gravity latch according to the invention is in combination with a remotely operable actuator adapted to be operated from the opposite side of the gate to the gravity latch, the actuator including an elongate member projecting into the housing at a lower portion thereof to engage a portion of the latch element generally on the opposite side of the horizontal axis to the retraction element.

Preferably, the lock mechanism is also actuatable to lock the closure member into the first position. In other words, the gravity latch can be locked into the "open" position. This is extremely useful where a person is carrying loads through the door or gate and does not want the door or gate to latch behind them, as they intend passing through a number of times with loads. Having to actuate the gravity latch every time they wish to pass through the door, as is the case with prior art gravity latches, is an irritant and can be awkward. Often, gates or doors may be spring loaded so that they are biased shut. This feature is particularly useful with such gates or doors.

The present invention is especially useful for doors and gates such as garden gates. Normally the latch is installed on the inside so that the gate swings inwardly and a keyed lock thereby permits security to be established even if there is access for an adult person reaching over the gate from outside to the latch. To avoid reaching over the gate and also to provide a system useable with much higher gates, it would be advantageous to provide an arrangement to permit remote actuation of a gravity latch according to the first aspect of the invention or otherwise designed.

According to a second aspect of the invention, there is provided a remote actuator for a gravity latch comprising mounting means for mounting an actuator on a remote structure, the actuator including an elongate member adapted to project from a remote location and adapted to interengage within a housing of the gravity latch such that on axial displacement of the elongate member, a latching element of the gravity latch is displaced to open the latching arrangement.

Preferably the actuator is spring biased away from the gravity latch and can be displaced against the spring biasing so that a projecting finger of the actuator normally located behind a downwardly depending portion of the latch element pivots the latch element forwardly upon engagement with the downwardly depending portion.

Preferably the actuating element comprises a thin rod-like member.

Further preferred or optional features of embodiments of the invention will be described hereinafter with reference to the accompanying drawings. The invention may be defined as comprising either the latch device or the remote actuating device or a combination of both such components.

For the purpose of exemplification only, an embodiment of the invention will now be described with reference to the accompanying drawings, of which:

Referring to the drawings, a latch arrangement in accordance with an embodiment of the present invention is illustrated. The same reference numerals are used throughout the Figures for the same components.

Figure 1:
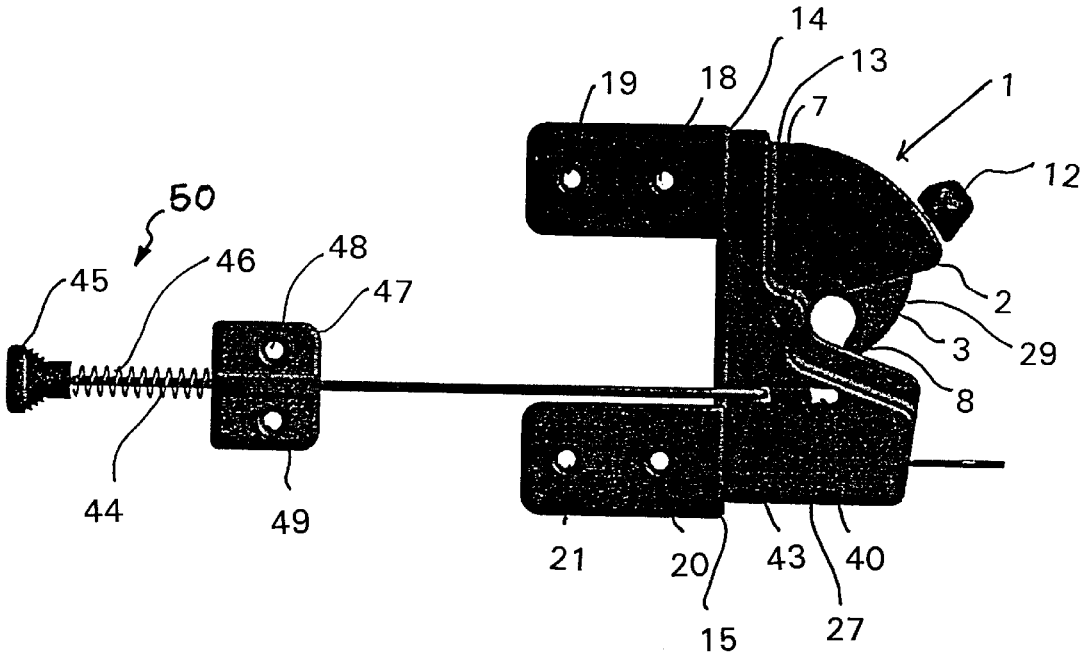
FIG. 1 is a side view of a latch arrangement in accordance with an embodiment of the present invention, showing the latch with an opening mechanism for opening the latch from the opposite side of the gate or fence where the latch is mounted
Figure 2:
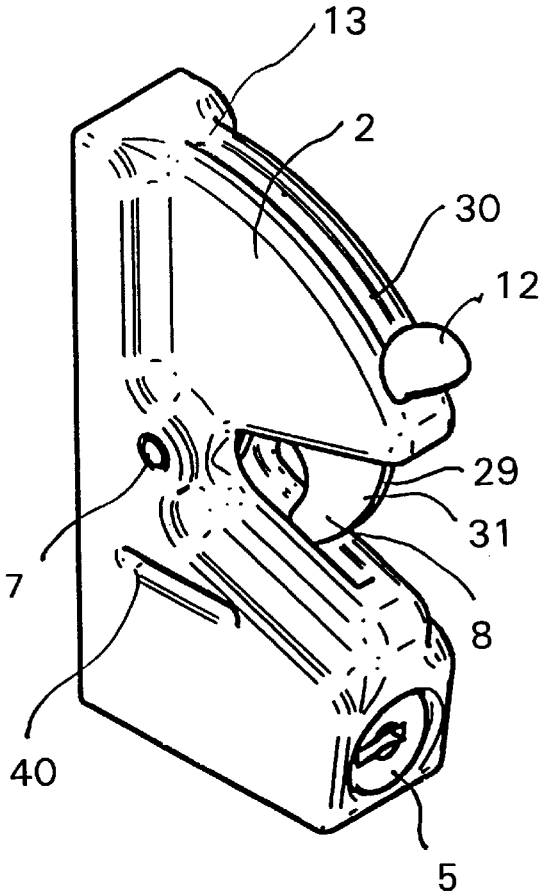
FIG. 2 is a perspective view from the front of a latch arrangement in accordance with an embodiment of the present invention.

A gravity latch, generally designated by reference numeral 1, comprises a housing 2 which mounts a closure member 3, moveable between a second position as shown in the drawings, in which a striker member 4 is engaged and held, and a first position in which the striker member 4 can be released so that a door or gate to which the arrangement is mounted may be opened.

A locking mechanism 5,6 is arranged to lock the closure member 3 in the second position so that the latch cannot be opened.

In this embodiment, the housing 2 totally encloses and mounts the lock mechanism 5,6 and the closure member 3. The closure member 3 is a closure tongue plate which is pivotally mounted to the housing about a horizontal axis through a pivot pin 7.

Figure 4:
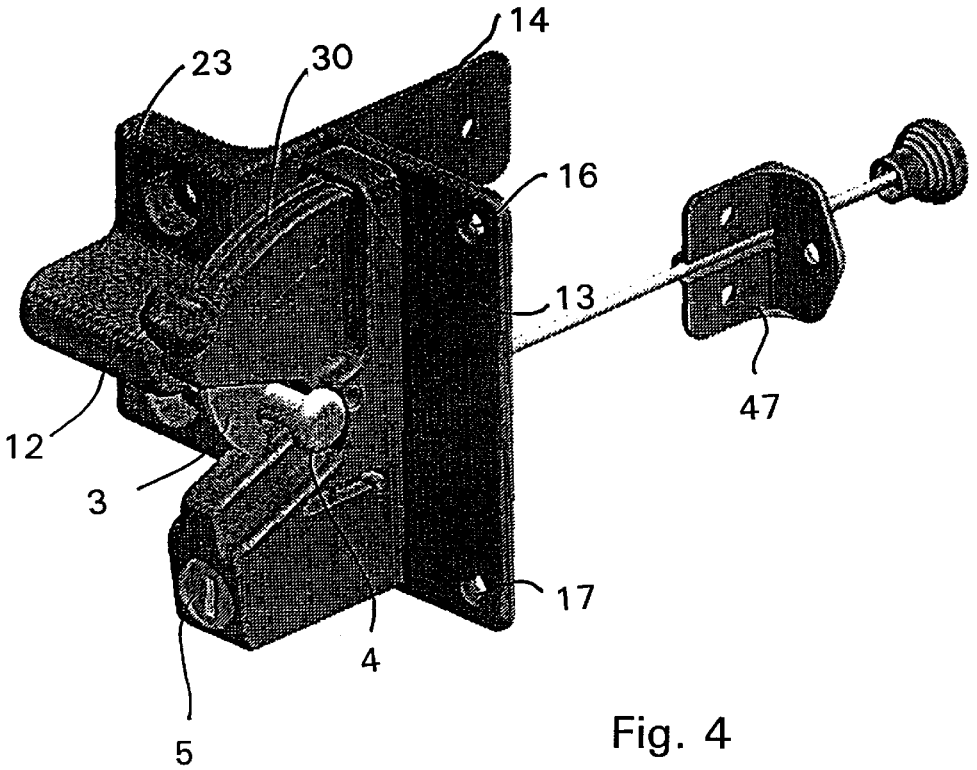
FIG. 4 is a perspective view from the front and one side of the latch arrangement, showing the latch arrangement in combination with a striker arm.
Figure 8:
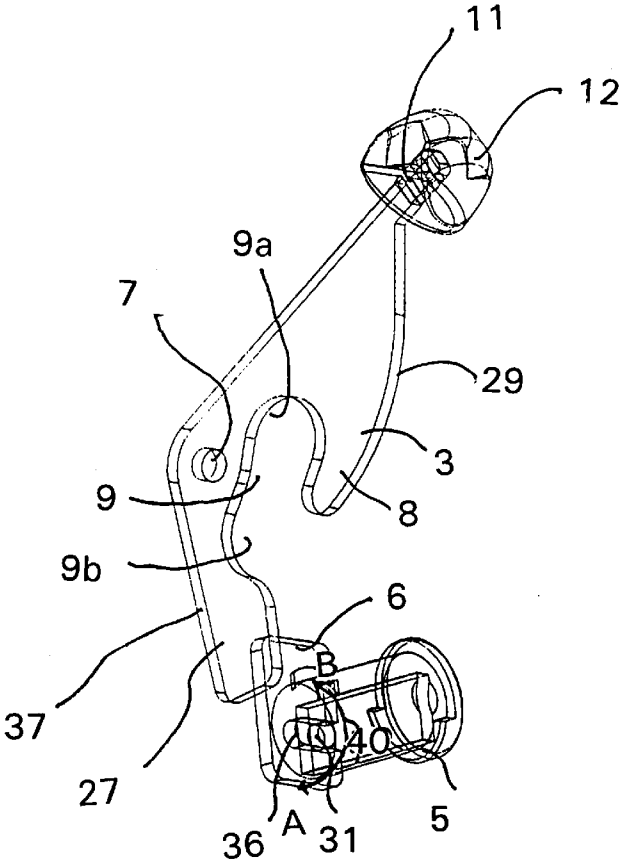
FIG. 8 is a detail perspective view in three-dimensional line form of components of the latch arrangement.
Figure 9:
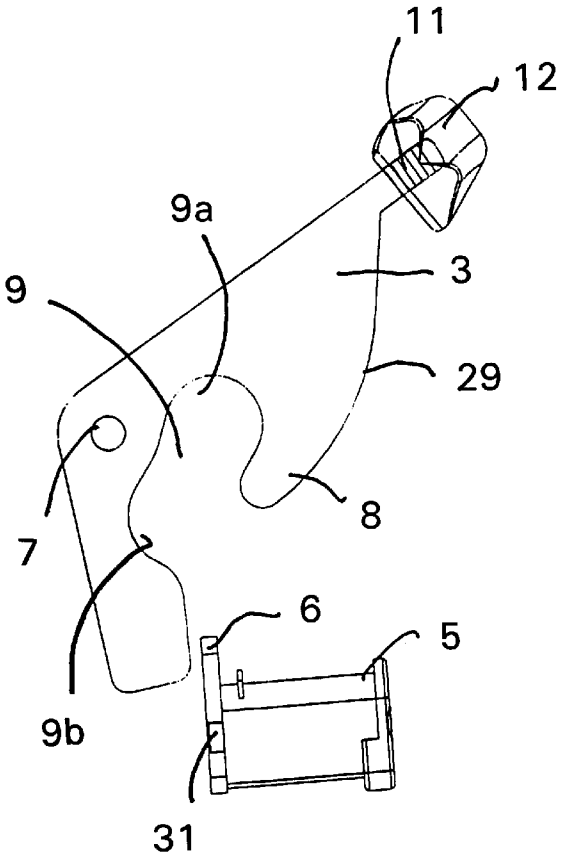
FIG. 9 is a line drawing from the side of FIG. 8.

The tongue closure plate 3 (as best shown in FIGS. 8 and 9) comprises a projecting tongue 8 which projects over a recessed portion 9 having lobes 9*a* and 9*b* in the plate 3. In the second position, as shown in the drawings, particularly FIGS. 4 and 5, it can be seen that the striker member being in this embodiment a striker 4, lodges in the recessed portion 9 behind the tongue 8 when the tongue closure member 3 is in the second position. The striker arm 4 is thus retained in the recess 9 between the recess 9, the tongue 8 and recessed portion 10 of the housing which is formed adjacent the pivot pin 7.

The tongue closure plate 3 also has a an upper projecting portion or tab 11 which mounts a knob 12. A person operates the knob 12 to move the tongue closure plate 3 from the second to the first position. In the first position, the knob 12 is adjacent the top 13 of the housing and the tongue 8 no longer projects into the recess 10 in the housing 2, allowing the striker arm 4 to be released and to be moved out of the recess 10 in the housing 2, i.e. allowing the gate or door to be opened.

The tongue closure plate 3 is also provided with a lower projecting portion 27 which projects toward the base 28 of the housing when the tongue closure member 3 is in the second position. The arrangement of the pivot pin 7, lower projecting portion 27 and tongue 8 is such that the weight dispositions in the tongue closure member 3 biases the tongue closure member 3 into the second position due to gravity.

Figure 5:
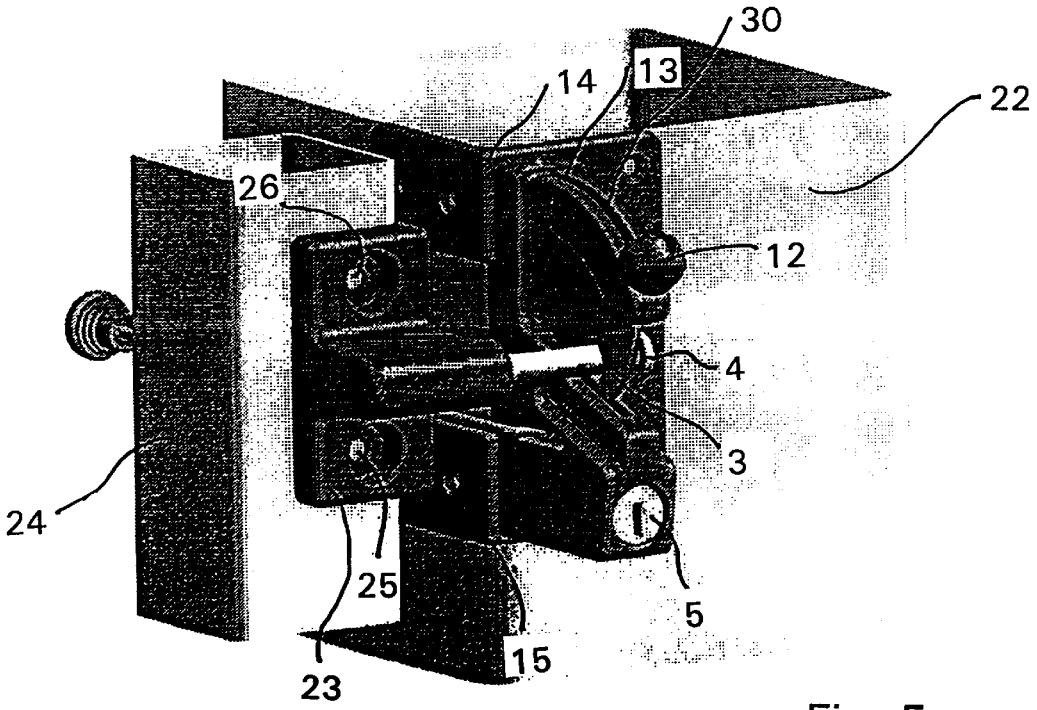
FIG. 5 is a perspective view from the front and the other side of a latch arrangement shown mounted to a fence and gate post arrangement and also illustrating striker arm.

A forward edge 29 of the tongue closure member 3 is curved to form a cam surface. When the gate or door is moved towards the closing position (as shown in FIG. 5), because the tongue closure member 3 is in the second position because of gravity bias, the striker arm 4 strikes the cam surface 29, and causes the tongue closure member 3 to move upwardly towards the first position, the surface 29 travelling along the striker arm 4. When the tongue 8 is moved sufficiently towards the first position, the striker arm 4 passes under the tongue 8 into the recess 9, and the tongue 8 then closes over the arm 4 to retain the arm 4 with the latch in the closed or second position.

A slot 30 is provided in the upper part of the housing 2 to allow for the tab 11 of the tongue closure member 11 and give it freedom of motion between the first and second positions.

The locking mechanism comprises a barrel lock 5 and a locking plate 6. A projection 31 on the barrel 5 engages with a slot 32 in the locking plate 6. The locking plate 6 is mounted within a further slot 33 in the housing 2, for movement between a first position where the locking plate 6 is retained in the lower part of the further slot 33*a* and a second position where the locking plate 6 is positioned in the upper part 33*b* of the further slot 33. The locking plate 6 is moved between the lower part 33*a* and upper part 33*b* of the slot 33 by rotation of the projecting portion 31 as the barrel lock 5 is rotated. Projecting portion 31 moves between points A and B as indicated by arrow 40 in FIG. 8.

Figure 7:
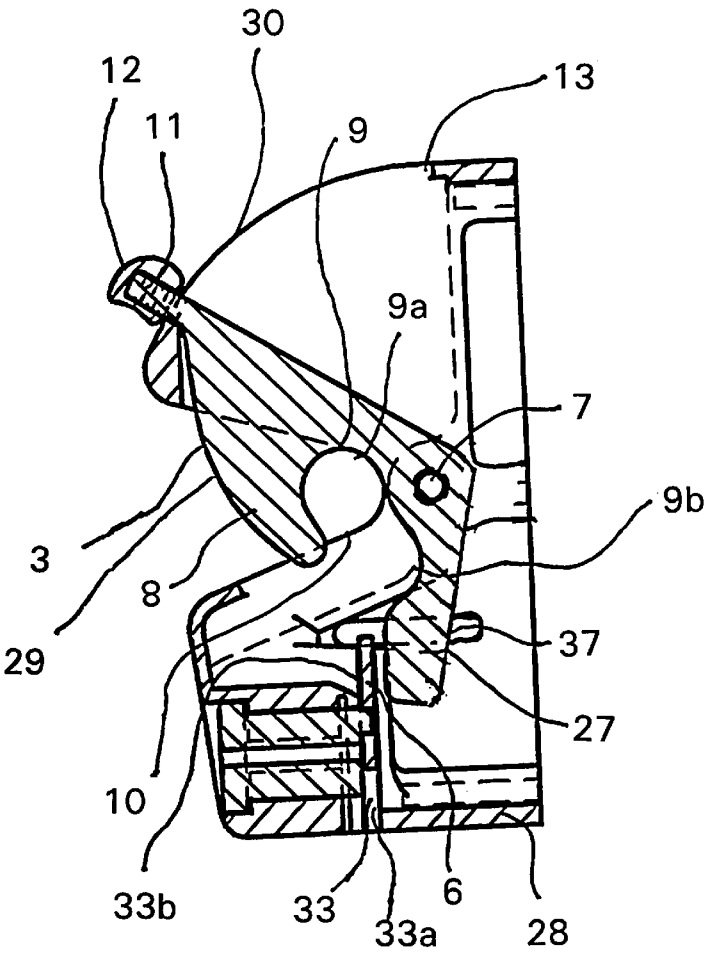
FIG. 7 is a section on A—A of FIG. 12 of the latch arrangement.
Figure 10:
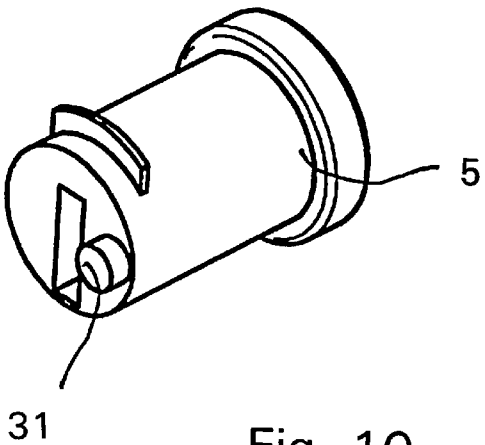
FIG. 10 is a perspective view from above and behind of the lock of the latch arrangement.
Figure 11:
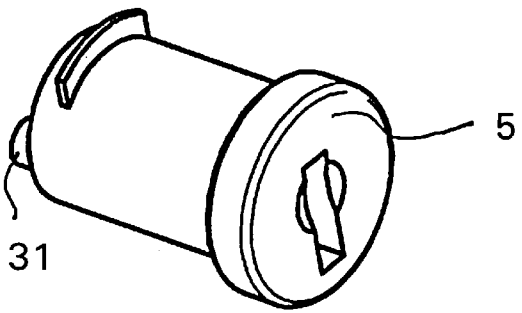
FIG. 11 is a perspective view from above and in front of the lock of FIG. 10.

When the locking plate 6 is in the second position, i.e. it is in upper part 33*b* of the slot 33, it can be seen (see particularly FIG. 7) that it is in a position to prevent motion of the lower projecting portion 27 forwardly, i.e. to prevent motion of the tongue closure plate from the second position to the first position. The latch is locked.

Another advantage of this arrangement is that the latch can be locked in the open position (tongue closure plate 3 in first position). This is done by actuating the lock mechanism 5,6 when the tongue closure plate 3 has been moved towards the first position. The bottom projecting portion 27 has a rear facing edge 37 which engages with the locking plate 6 when the locking plate 6 is in the second position, i.e. positioned within the upper part 33*b* of the slot 33. The locking plate 6 then prevents the tongue closure plate 3 from returning to the second position by virtue of the surface 37 abutting against the forward side of the locking plate 6.

This feature is particularly useful where the gate is a spring biased gate which is biased shut. The latch can be locked into the open position preventing latching shut of the gate if a person wishes to carry a number of loads through the gate and does not wish to have the irritation of opening the latch every time they pass through the gate.

Figure 3:
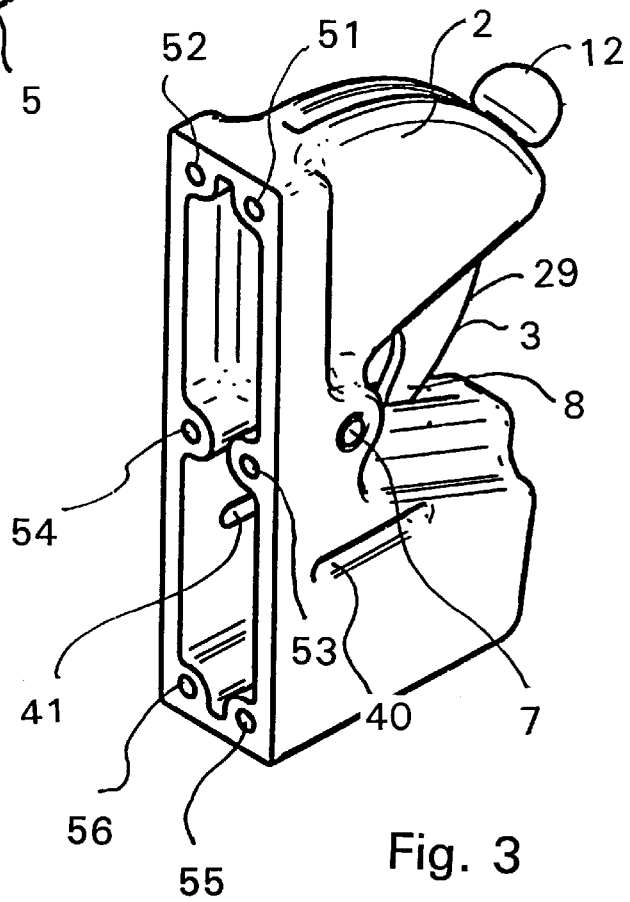
FIG. 3 is a perspective view from above and behind of the latch arrangement of FIG. 2.
Figure 13:
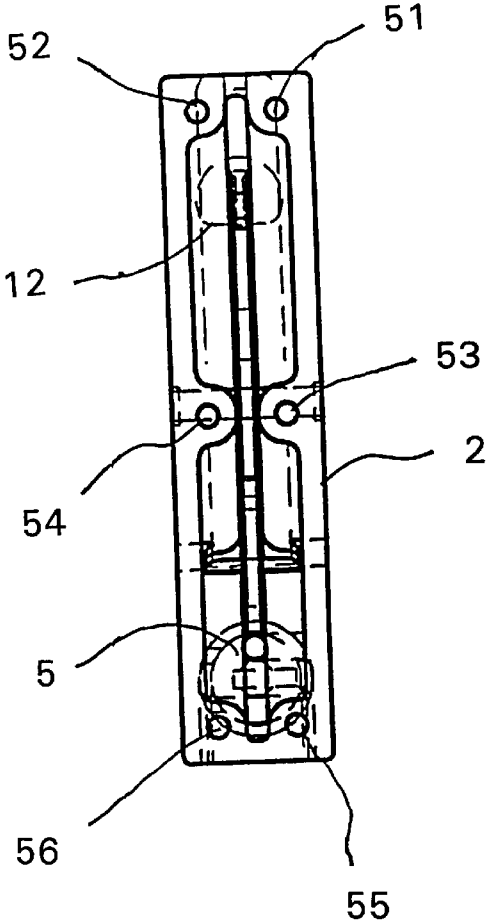
FIG. 13 is a rear view of the latch arrangement showing internal features in ghost outline.
Figure 12:
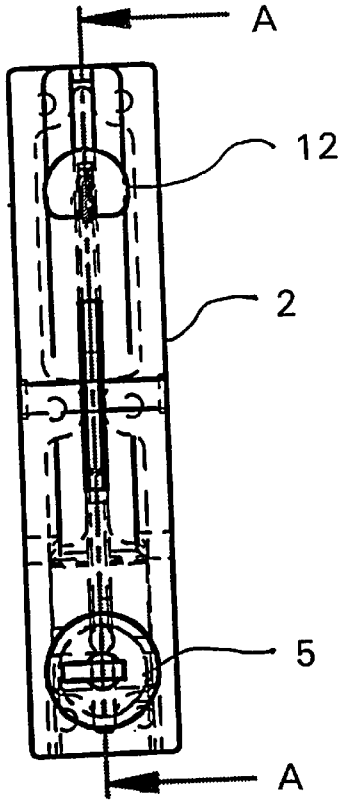
FIG. 12 is a front view of the latch arrangement showing internal features of the latch in ghost outline.
Figure 14:
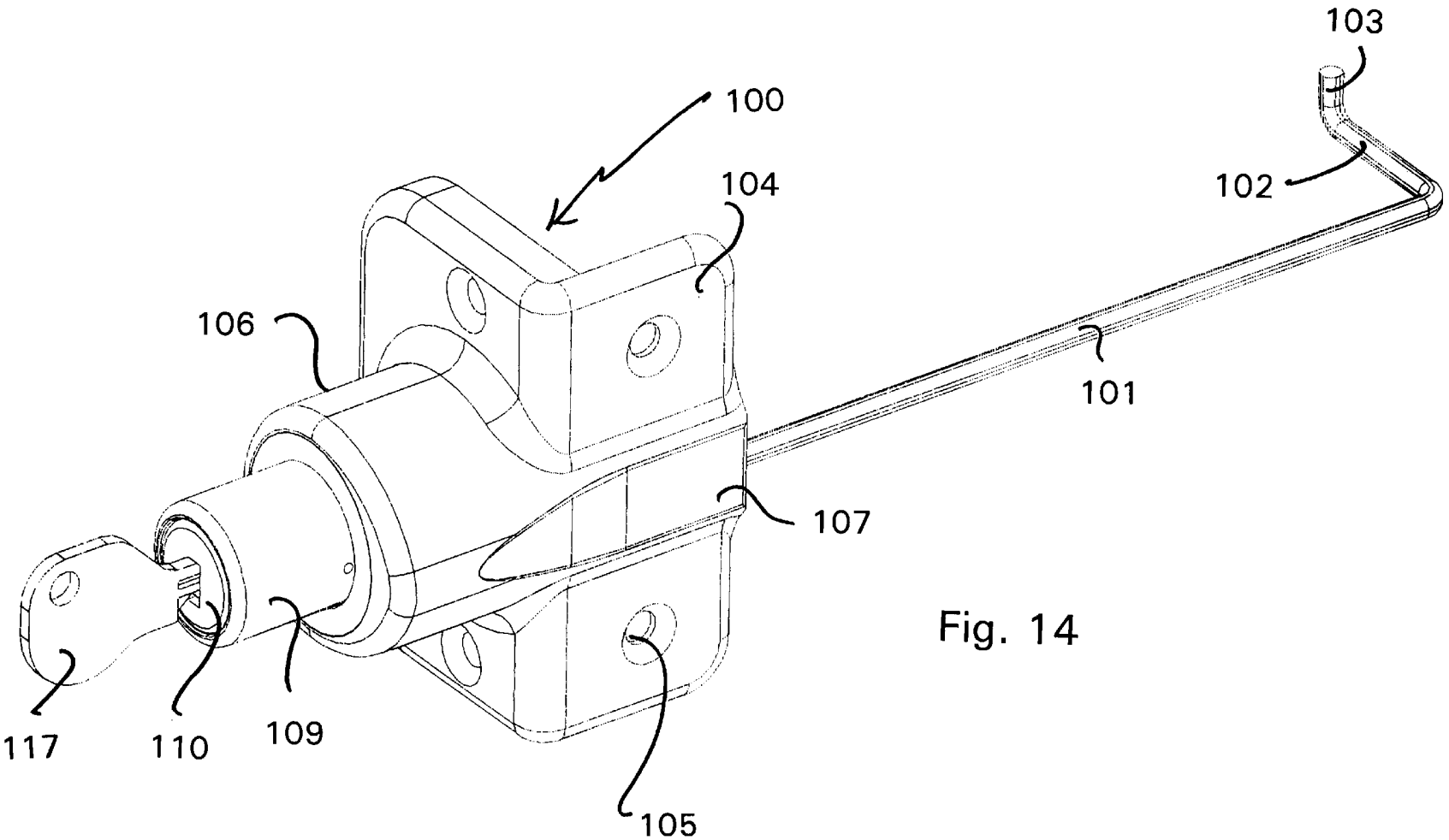
FIG. 14 is a view of an alternative locking remote actuator from one side.

Screw holes (FIG. 3, FIG. 13), 50,51,52,53,54,55 are provided in the housing 2 to mount the housing 2 to a brackets 14.

The bracket 14 is provided for mounting the latch arrangement via screw holes 16,17 18,19 20,21 and screws (not shown) to a door post or gate post or the like 22 (FIG. 5). The striker arm 4 is also provided with a mounting bracket 23 for mounting it to a limb 24 of a gate or door (not shown) via screw holes 25 and 26 and screws (not shown).

The latch arrangement in accordance with this embodiment of the present invention also includes an opening mechanism which enables a person to open the latch by actuation of an actuating member which is mounted on the opposite side of the gate or fence to the latch arrangement.

Figure 6:
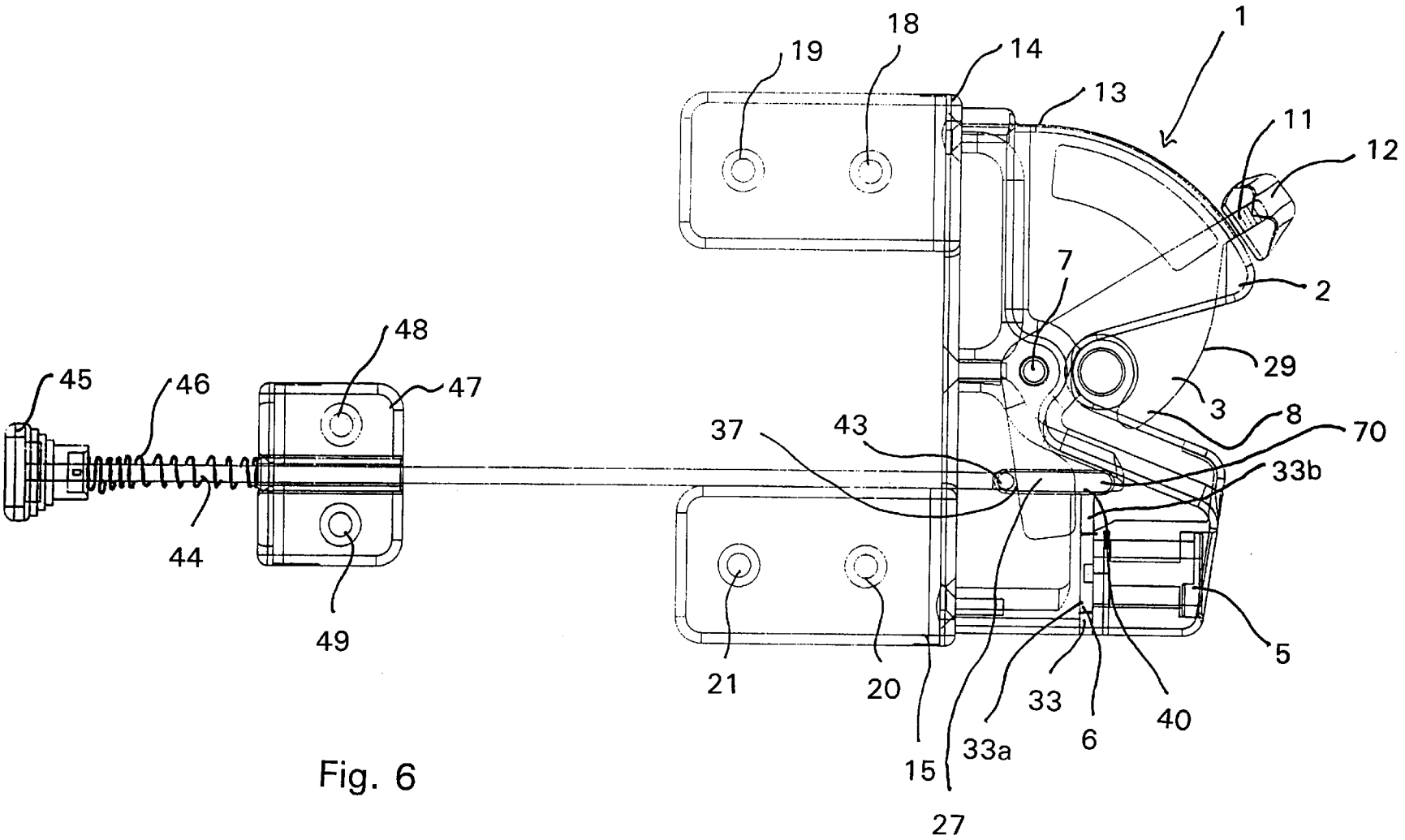
FIG. 6 is a line drawing of a side view of the latch arrangement.

For linkage with the opening mechanism, the housing 2 a pair of slots 40,41 in the sides of the housing 2 which provide support for an opening finger 43 to slide between a first retracted position (as shown in the drawings), where the tongue closure plate is in its second position, and a second active position, where the tongue closure plate 3 is pushed into its first position. The active position of the closing finger 43 is at the forward end 70 (see FIG. 6) of the slots 40,41. The opening finger 43 pushes against the surface 37 of the lower projecting portion 27 to cause the closure plate 3 to pivot anti-clockwise (as seen in FIG. 6) about the pivot pin 7 towards the first position.

The rear surface 37 of the lower projecting portion 27 is substantially straight, so that the opening finger 43 rides along the surface and pushes the closure member 3 sufficiently far towards the first position to enable the latch to be opened.

In this embodiment, the opening finger 43 is integral with an actuating push rod 44. The push rod 44 is long enough to extend though the gate post or fence to the opposite side from the latch arrangement. A user merely needs to push rod 44 by way of knob 45 (which together comprise a "remote actuator 50") to cause the latch 1 to be opened. A biasing spring 46 is provided to bias the push rod 44 so that the opening finger 43 is biased towards its retracted position. A bracket 47 is provided with screw holes 48 and 49 for mounting the push rod 44 to the opposite side of the fence or gate post.

It will be appreciated that the mounting arrangement, i.e. brackets and screw holes as shown in this embodiment, may be different. The housing 2, for example, could be mounted directly to a fence or gate post for example.

It will also be appreciated that the housing may be of different shape and may not be a total enclosure as is preferably the case in this embodiment. It may for example be a framework comprising two or more pieces, as is conventional with some known gravity latches, but incorporating a portion for mounting of the lock mechanism.

The closure member need not necessarily be a tongue closure plate, but could be any member which performs the latching function and can be gravity biased.

In operation, the latch arrangement will be generally mounted to a gate post or door post and the striker arm mounted to the door or gate. The invention is not limited to this mounting arrangement, however, and it may be reversed in some circumstances. Further, although the latch arrangement is particularly designed for an outer gate of fence (i.e. not a security door), it is possible that it could be used for locking other closure members, e.g. any type of door, etc.

The guide means for the opening mechanism and opening member need not be slots as illustrated in the present embodiment, but could be any means for guiding the opening member in the required path.

The latch arrangement may be made of any convenient materials but preferably stainless steel or the like so as to limit damage by corrosion. The housing is preferably stainless steel although it may be of durable plastics.

Reference will now be made to FIGS. 14 to 17 showing a further inventive arrangement namely an optional, lockable remote actuator suitable for use with the latching arrangement shown in FIGS. 1 to 13.

This actuator 100 comprises an actuator rod 101 terminating in a transverse finger 102 which is adapted to be inserted in the slots 40,41 in housing 2, an upturned tip 103 of the finger acting to retain the finger in the assembled arrangement. In this embodiment the rod 101 is of a form so that it is mounted in a mounting shroud 104 so that the rod extends exterior of and alongside the outer face of a gate post or similar structure. Thus, simple and convenient installation can be provided through a wide range of applications including both left hand and right hand installations.

Figure 15:
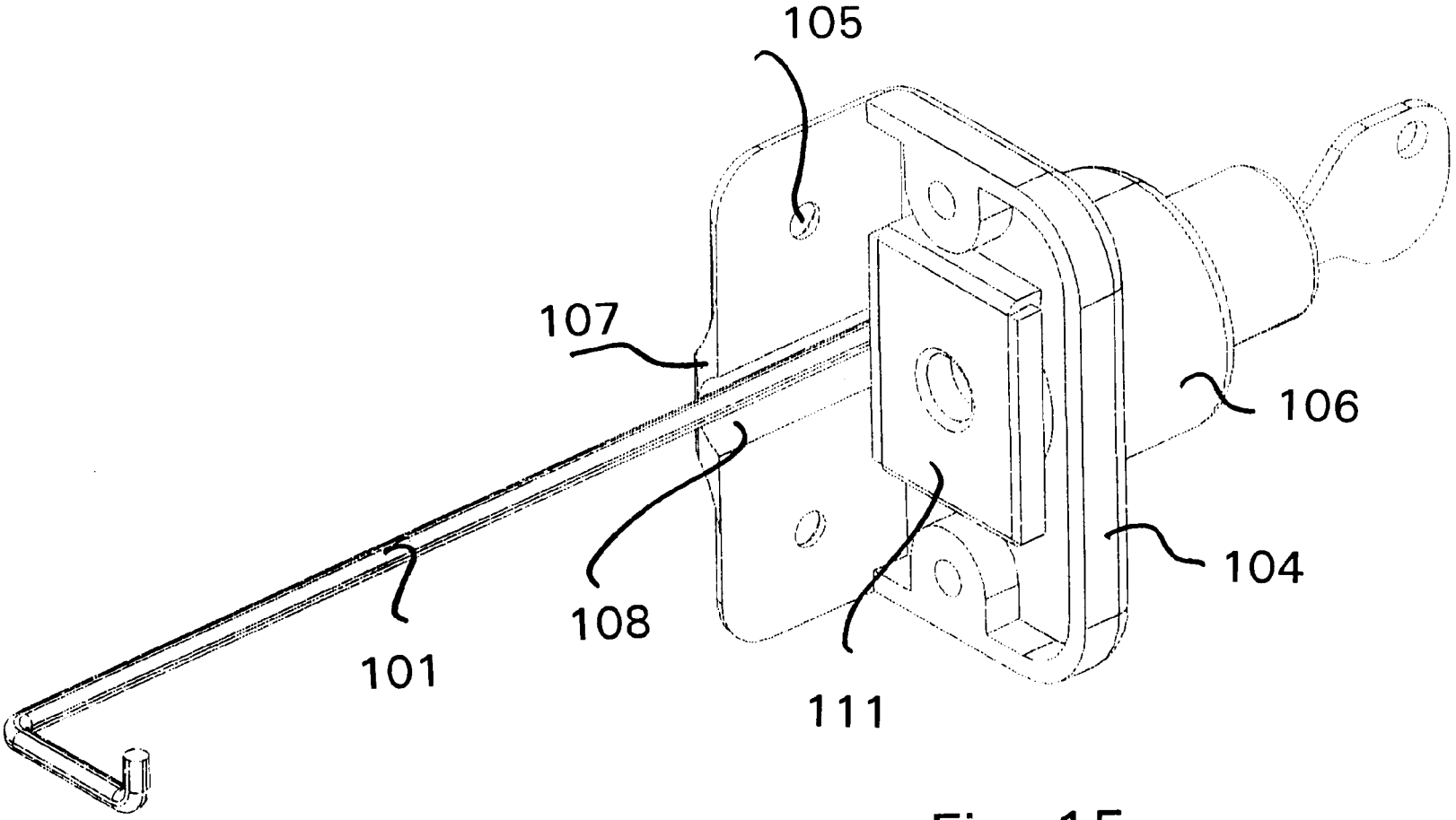
FIG. 15 is a view of the actuator of FIG. 14 from the opposite side.

The mounting shroud 104 is L-shaped in plan view and has counter sunk bores 105 for receiving fixing screws whereby the shroud can be securely mounted on a gate post. The shroud has a cylindrical extension 106 for accommodating a lock mechanism and a lateral enlargement 107 below which a cavity 108 is defined for accommodating the rod 101 as best shown in FIG. 15.

Although not shown in the drawing, the end of the push rod 101 is arranged to be interengaged with a push button 109, spring biasing being provided to bias both the rod 101 and the button 109 to the retracted position shown in the drawing. The button 109 contains a barrel lock 110 and when unlocked the button is depressed to displace the push rod 101 to open the latching arrangement 1.

Figure 16:
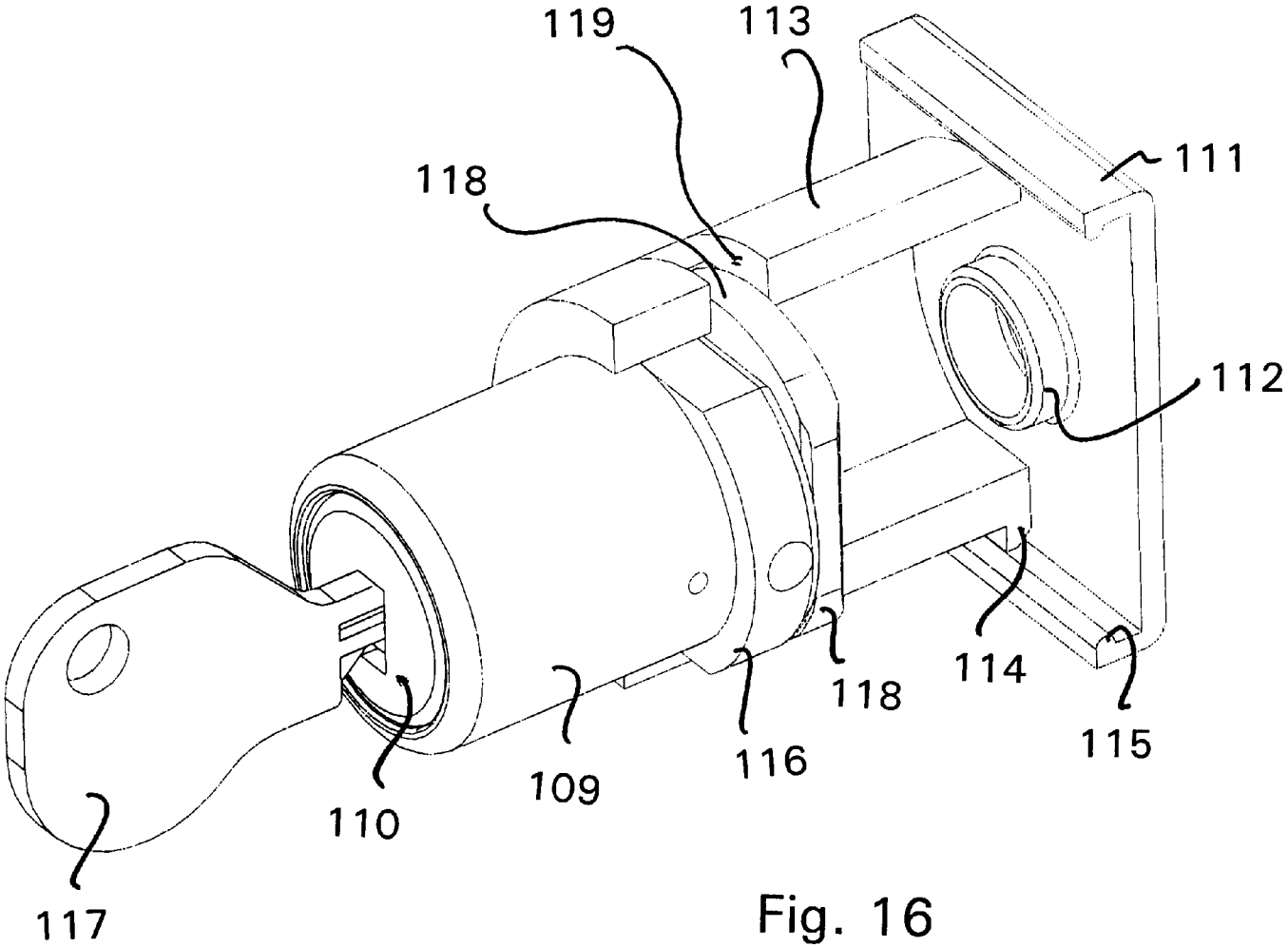
FIG. 16 is a broken-away view of the actuator with a mounting shroud removed and showing a lock unit in a locked position.
Figure 17:
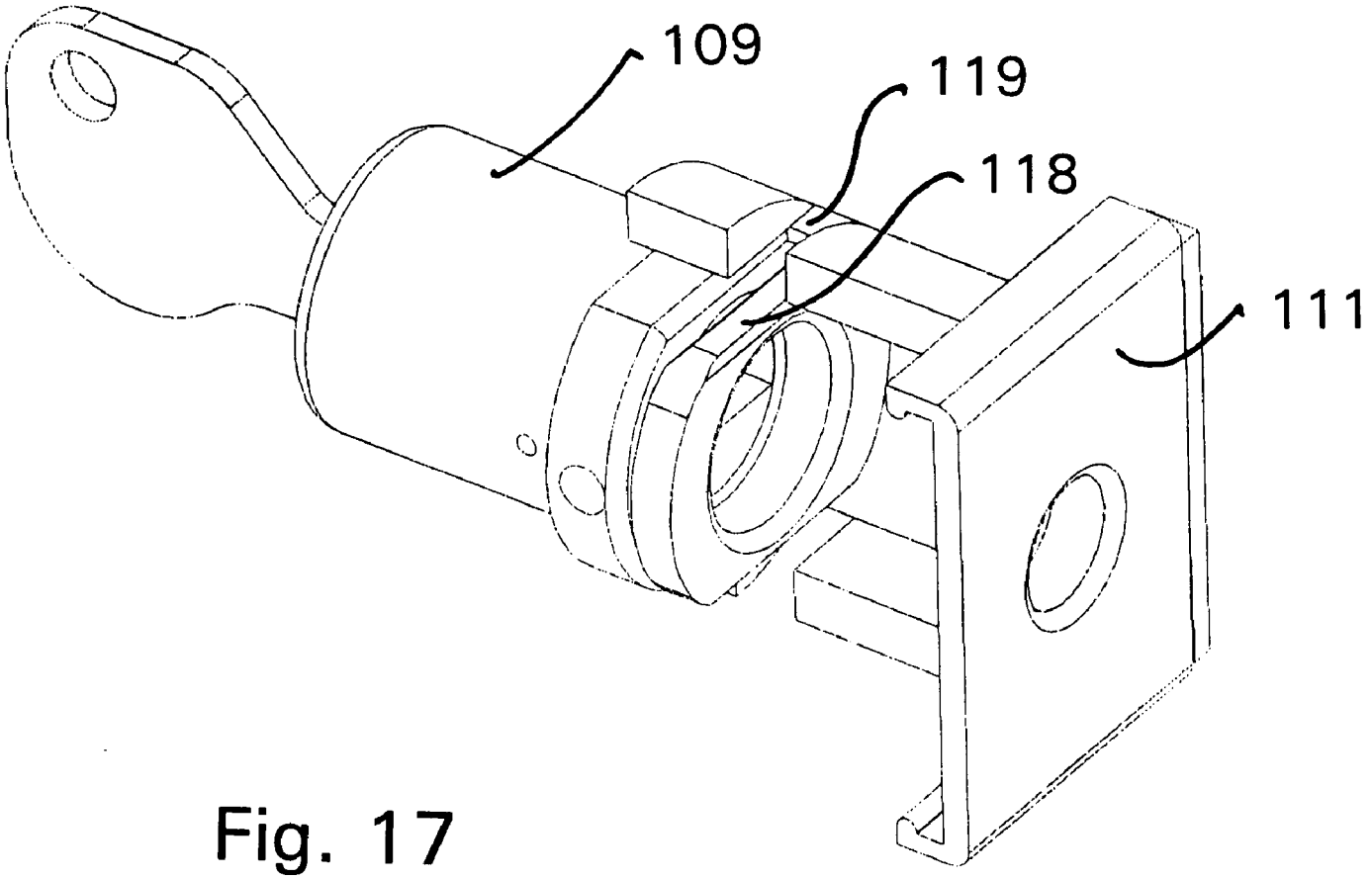
FIG. 17 is a view corresponding to FIG. 16 but from another angle and showing the lock unit in an unlocked portion.

Removal of the shroud 104 provides access to the locking arrangement shown in FIGS. 16 and 17 which comprises a base plate 111 having an upstanding collar 112 on which a helical compression spring (not shown) is located. The collar 112 is located centrally relative to an oval tubular mount 113 having upper and lower out-turned lips 114 which engage in respective undercut shoulders 115 at the top and bottom of the mounting plate 111. The push button 109 has a flanged base 116 which is also oval and is a sliding fit in the tubular structure 113. The lock 110 is adapted to be actuated by a key 117 which displaces laterally locking plates 118 between a retracted position shown in FIG. 17 and an extended position shown in FIG. 16 wherein the locking plates 118 extend into respective slots 119 in the upper and lower walls of the tubular structure 113.

If desired a further pair of slots could be provided in the tubular structure 113 near the mounting base 111 to correspond with locking the actuating rod 101 in a position corresponding to the open position for the latching arrangement 1.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The claims defining the invention are as follows:

1. A gravity latch and striker arm for releasably securing a swingable gate, fence, door or similar structure, the gravity latch comprising:

(a) a housing adapted to be mounted on a structure;

(b) a pivotal latch element pivotally mounted in the housing for rotation about a horizontal axis between an open position and a gravitationally biased closed position, the latch element defining an interior recess for retaining a portion of the striker arm when the latch element is in the closed position;

(c) the housing having a lateral aperture to accept and guide the striker arm towards the horizontal axis and engagement with the latch element;

(d) the latch element, in the closed position, having a striker surface exposed via the lateral aperture to be engaged by the striker arm compelling the latch element to rotate towards the open position thereby enabling entry of the striker arm into the interior recess;

(e) the interior recess defining a profile to facilitate retention of the striker arm by the latch element once the gravitational bias closes the latch element;

(f) a retraction element connected to the latch element extends from the housing permitting the latch element to be manually rotated from the closed position to the open position to release the striker arm;

(g) the housing also includes guiding means for guiding the latch element during rotation between the open and closed positions, the guiding means being remote from the horizontal axis, and the housing further including a shroud portion for enshrouding a lower depending portion of the pivotal latch element and for mounting a lock structure accessible by a key through a front portion of the latch housing, the lock structure being arranged to lock the lower depending portion of the latch element at least in the closed position.

2. A gravity latch as set forth in claim 1 wherein the lock structure is located below the lateral aperture and operated by a key, the lock having an upwardly displaceable plate moveable in response to rotation of the key to engage a downwardly depending tongue portion of the latch element.

3. A gravity latch as set forth in claim 1 wherein the latch element is a thin plate and the retraction element is an upwardly projecting tab integral with the latch element, the tab protruding from and being manually moveable via a slot in the housing.

4. A gravity latch as set forth in claim 1, in combination with a remotely operable actuator adapted to be axially displaced from an opposite side of the structure upon which the latch is mounted, the actuator including an elongate member communicating with the downwardly depending portion of the latch element.

5. A gravity latch as set forth in claim 1 further comprising a remote actuator having an elongate member extendably communicating between the remote actuator and the gravity latch and adapted to influence the pivotal latch element within the housing and when the lock structure is unlocked than an axial displacement of the elongate member causes the latch element to pivotably open and release the striker arm.

6. The remote actuator as set forth in claim 5 including a springably biased elongate member for biasing the actuator to a retracted position wherein it does not interfere with operations of the latch element.

7. The remote actuator as set forth in claim 6 including locking means for locking the elongate member at least in the retracted position.

8. The remote actuator as set forth in claim 7 supported by a mounting shroud for mounting on a gate post, doorway or similar structure and having a duct for slidably accommodating the springably biased elongate member as well as the locking means.

9. The remote actuator as set forth in claim 8 wherein the mounting shroud mounts and accommodates a non-circular cylindrical structure adapted to accommodate, via a sliding fit, a correspondingly shaped base portion of a lock barrel, the non-circular cylindrical structure having at least one lateral slot for accommodating a laterally displaceable lock element of the lock barrel at a selected position.

* * * * *